US005875523A

United States Patent [19]

Chen

[11] Patent Number: 5,875,523

[45] Date of Patent: Mar. 2, 1999

[54] BELT AND BUCKLE ARRANGEMENT

[76] Inventor: Kuo-Jen Chen, No. 2-1, Lane 48, Tai-Yuan Rd., Taipei, Taiwan

[21] Appl. No.: 972,321

[22] Filed: Nov. 18, 1997

[51] Int. Cl.[6] ..... A44B 11/00

[52] U.S. Cl. ..... 24/171; 24/164; 24/170; 24/191

[58] Field of Search ..... 24/171, 163 K, 24/181, 194, 170, 191, 164, 168, 179

[56] References Cited

U.S. PATENT DOCUMENTS

| | | | |
|---|---|---|---|
| 862,571 | 8/1907 | Mathers | 24/170 |
| 910,258 | 1/1909 | Young et al. | 24/164 |
| 939,902 | 11/1909 | Garrison | 24/170 |
| 1,050,470 | 1/1913 | Kurtz | 24/164 |
| 5,732,448 | 3/1998 | Shields et al. | 24/191 |

FOREIGN PATENT DOCUMENTS

| | | | |
|---|---|---|---|
| 1333646 | 6/1963 | France | 24/191 |

*Primary Examiner*—Victor N. Sakran
*Attorney, Agent, or Firm*—Bacon & Thomas

[57] ABSTRACT

A belt and buckle arrangement which includes a buckle unit having a frame and tongue unit and a mounting strip fastened to one end of the frame and tongue unit, a belt detachably connected to a coupling portion at one end of the mounting strip, a connecting device adapted to connect the belt to the mounting strip, the connecting device including a mounting frame fixedly fastened to the coupling portion of the mounting strip, and a locking lever pivoted to the mounting frame and adapted to hold down a lead end of the belt on the mounting frame, and a belt keeper detachably connected to the mounting frame and adapted to hold a tail end of the belt in place.

8 Claims, 4 Drawing Sheets

BELT AND BUCKLE ARRANGEMENT

BACKGROUND OF THE INVENTION

The present invention relates to a belt and buckle arrangement, and more particularly to such a belt and buckle arrangement which permits the belt to be replaceably and adjustably connected to the buckle and, which has a detachable keeper for holding the free end of the belt.

A belt is an important accessory of a suit. It is used not only as fastening means for securing pants/skirt to the waist, but also as decorative means for decorating the dress. In order to match with different dress, different belts may be used. Further, if one's waistline is changed, the belt may have to be made with additional punch holes. FIG. 1 shows a belt and buckle arrangement according to the prior art, in which the buckle comprises a frame and a tongue pivoted to the frame; the belt has a head end stitched into a loop coupled to the frame, and a loop fixedly secured thereto for holding its free end. The loop may be decorated with a logo, mark, or any special design. When the buckle and the belt are fastened together, the buckle cannot be detached from the belt for a replacement, i.e., the user cannot change the design of the belt or the buckle to fit one's dress. Further, because the loop is fixedly secured to the belt, it cannot be removed from the belt for a replacement, i.e., the user is not allowed to change the design of the loop.

SUMMARY OF THE INVENTION

The present invention has been accomplished to provide a belt and buckle arrangement which eliminates the aforesaid drawbacks. According to one aspect of the present invention, the belt and buckle arrangement comprises a buckle unit having a frame and tongue unit and a mounting strip fastened to one end of the frame and tongue unit, a belt detachably connected to the mounting strip, and a connecting device adapted to connect the belt to the mounting strip. According to another aspect of the present invention, a belt keeper is detachably connected to the connecting device, and adapted to hold the free end of the belt in place.

DETAILED DESCRIPTION OF THE PREFERRED EMBODIMENT

Figure 1:
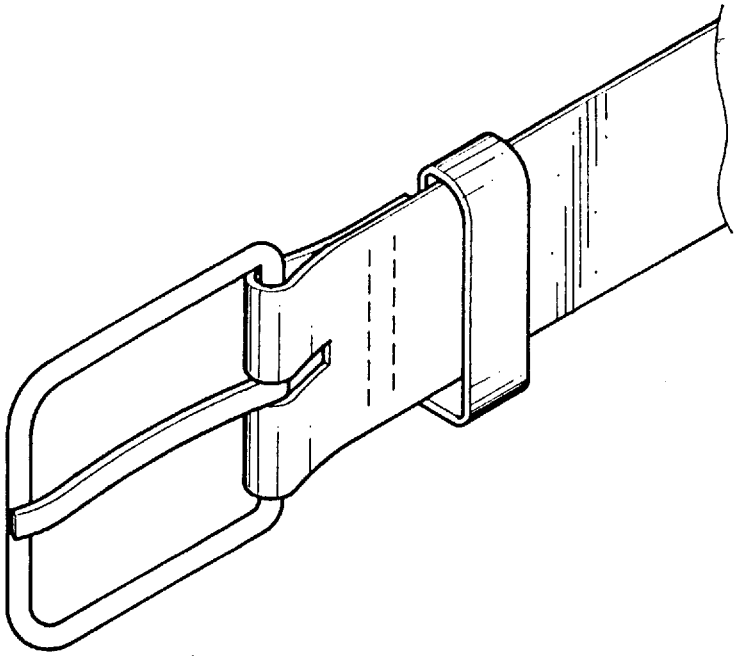
Fig. 1 PRIOR ART
FIG. 1 shows a buckle fastened to a belt according to the prior art.
Figure 2:
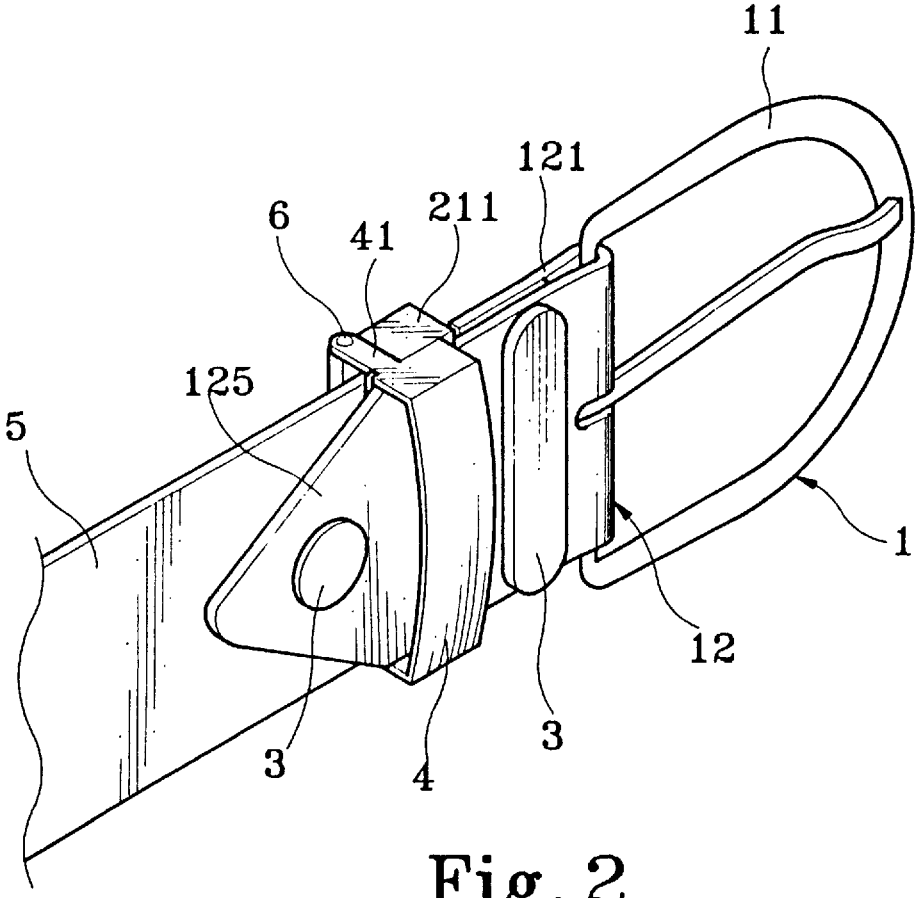
FIG. 2 is a perspective view of a belt and buckle arrangement according to the present invention.
Figure 3:
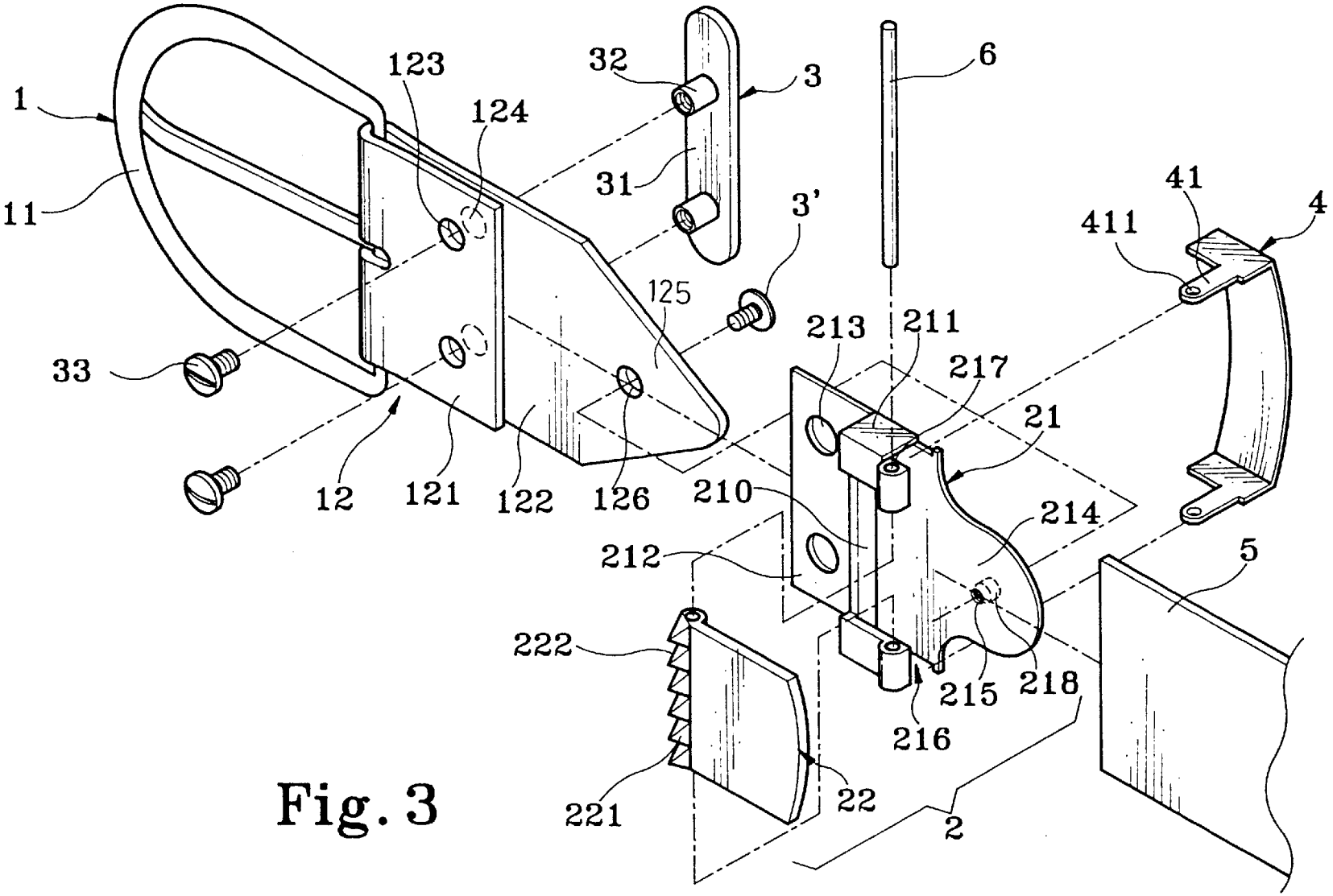
FIG. 3 is an exploded view of the belt and buckle arrangement shown in FIG. 2.

Referring to FIGS. 2 and 3, a belt and buckle arrangement in accordance with the present invention is generally comprised of a buckle unit 1, a connecting device 2, a locating member 3, a belt keeper 4, a pivot 6, and a belt 5.

The buckle unit 1 comprises a frame and tongue unit 11, and a mounting strip 12. The mounting strip 12 comprises a first part 122 having one end terminating in a coupling portion 125, a second part 121 integral with one end of the first part 122 remote from the coupling portion 125, a first mounting hole 126 at the coupling portion 125 of the first part 122, at least one for example two second mounting holes 124 at the first part 122 adjacent to the second part 121, and at least one for example two third mounting holes 123 at the second part 122 corresponding to the second mounting holes 124. The second part 121 of the mounting strip 12 is inserted through the frame and tongue unit 11, then turned backwards and covered over a part of the first part 122 and then secured thereto by the locating member 3. The connecting device 2 is adapted to connect the belt 5 to the mounting strip 12, comprised of a mounting frame 21, and a locking lever 22. The mounting frame 21 comprises a flat mounting base 212, a transverse stop plate 210 raised from the flat mounting base 212 at its bottom side, two lugs 211 bilaterally raised from the flat mounting base 212 at two opposite ends of the transverse stop plate 210 and defining a respective pivot hole 217, two mounting holes 213 disposed at the mounting base 212 corresponding the to mounting holes 123;124 on the mounting strip 12 in front of the transverse stop plate 210, two opposite retaining notches 216 respectively disposed adjacent to the lugs 211, a flat extension wall 214 extended from one end of the mounting base 212 in a flush manner remote from the mounting hole 213, an upright stub rod 218 raised from flat extension wall 214, and a screw hole 215 through the longitudinal central axis of the upright stub rod 218. The locating member 3 comprises a face panel 31, and two female screw rods 32 perpendicularly raised from a bottom side of the base panel 31. The pivot 6 is mounted in the pivot holes 217 of the lugs 211. The locking lever 22 is turned about the pivot 6 between the lugs 211, having an engaging portion 221 adapted to hold down the belt 5, and sloping guide faces 222 at the engaging portion 221 adapted to guide the belt 5 into position. The engaging portion 221 is for example a serrated portion adapted to engage the belt 5. The belt keeper 4 has two lugs 41 respectively perpendicularly raised from two opposite ends thereof and respectively retained to the retaining notches 216 on the mounting frame 21. The lugs 41 have a respective pivot hole 411 respectively coupled to two opposite ends of the pivot 6. Because the lugs 41 of the belt keeper 4 are respectively retained to the retaining notches 216, the belt keeper 4 is stopped from displacement when coupled to the pivot 6. The mounting frame 21 of the mounting device 2 is fastened to the mounting strip 12 by: fitting the upright stub rod 218 of the mounting base 21 into the first mounting hole 126 on the first part 122 of the mounting strip 12, then threading a screw 3' into the screw hole 215 on the upright stub rod 218 to secure the upright stub rod 218 to the first part 122 of the mounting strip 12, then inserting the female screw rods 32 of the locating member 3 in proper order through the second mounting holes 124 on the first part 122 of the mounting strip 12, the mounting holes 213 on the mounting base 212 of the mounting frame 21 and the third mounting holes 123 on the second part 121 of the mounting strip 12, and then threading respective screws 33 into the female screw rods 32 of the locating member 3 to fix the mounting base 212 of the mounting frame 21 in between the first part 122 of the mounting strip 12 and the second part 121 of the mounting strip 12.

Figure 4A:
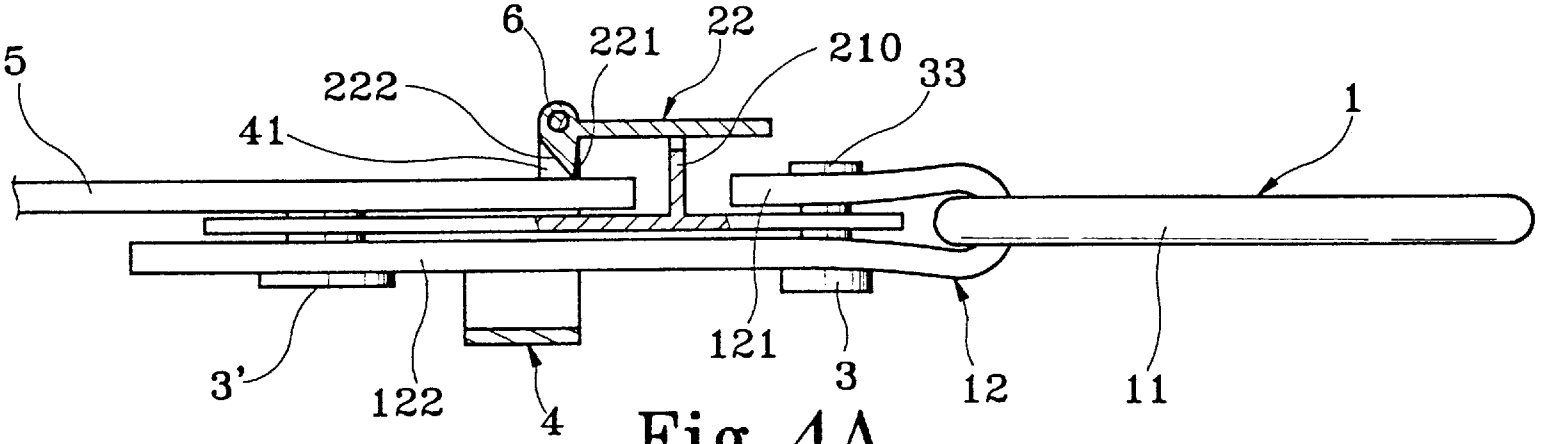
FIG. 4A is a sectional side view of the present invention, showing the locking lever locked.
Figure 4B:
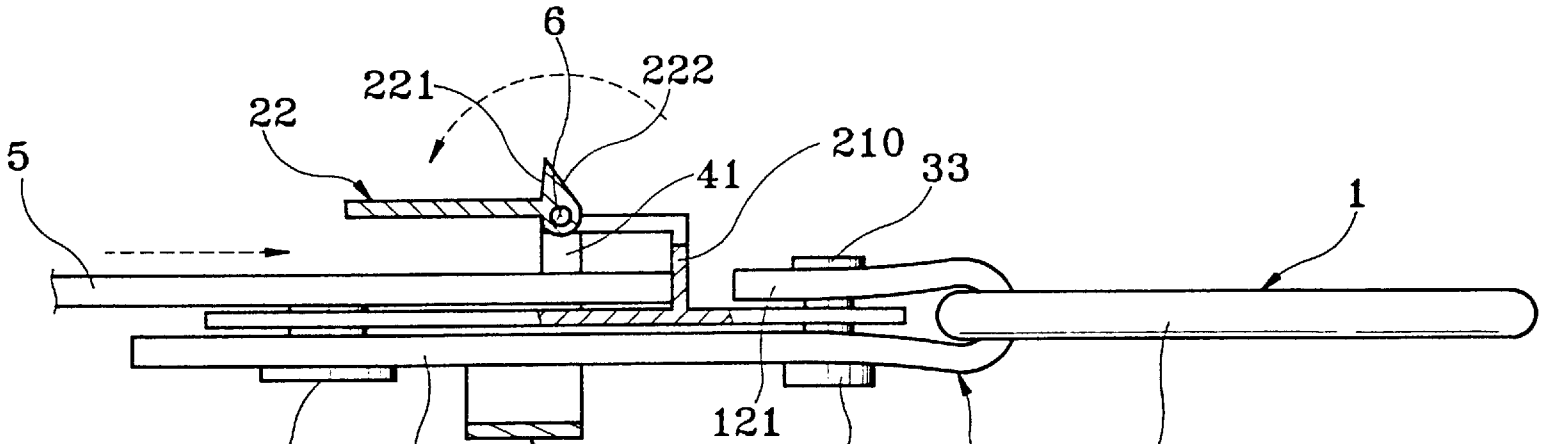
FIG. 4B is similar to FIG. 4A but showing the belt pushed forwards, the locking lever unlocked.

Referring to FIGS. 4A and 4B, when the locking lever 22 is opened, the lead end of the belt 5 is inserted into the mounting device 2 between the mounting frame 21 and the locking lever 22, then the locking lever 22 is turned about the pivot 8 from the unlocking position to the locking position to force the engaging portion 221 into engagement with the belt 5, thereby causing the belt 5 to be firmly secured to the connecting device 2. When the locking lever 22 is turned from the unlocking position to the locking position, the engaging portion 221 of the locking lever 22 is forced into engagement with the belt 5, and at the same time the belt 5 is moved backwards from the transverse stop plate 210 at a limited distance, and therefore a distance is maintained between the lead end of the belt 5 and the transverse stop plate 210 (see FIG. 4A). When the belt 5 is pushed forwards toward the transverse stop plate 210, the engaging portion 221 of the locking lever 22 is forced away from the belt 5, thereby causing the belt 5 to be disengaged from the locking lever 22 of the connecting device 2 (see FIG. 4B).

Figure 5:
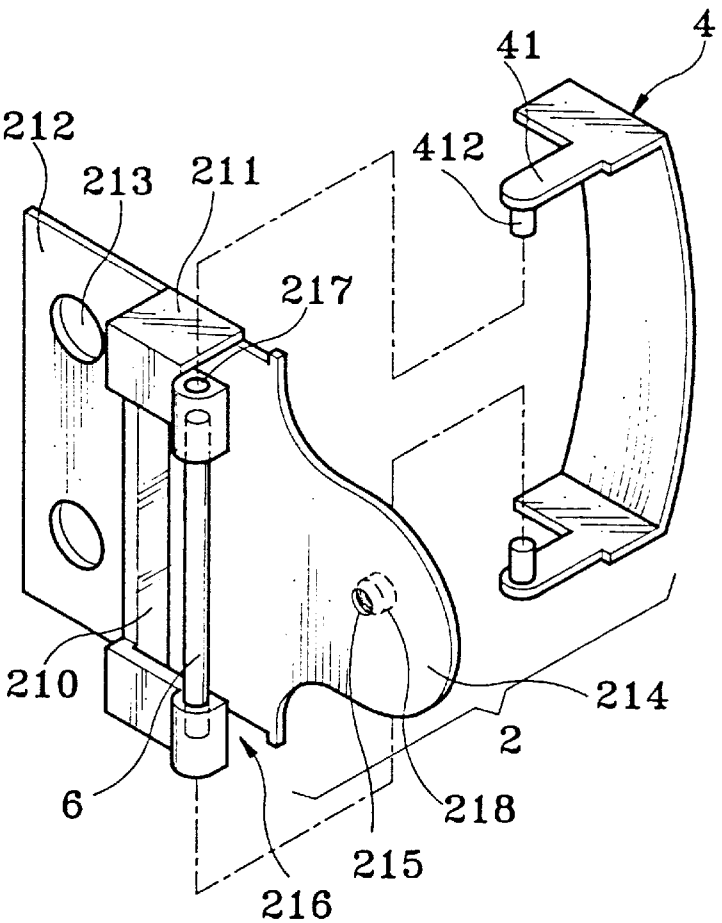
FIG. 5 is an exploded view of a part of an alternate form of the present invention.

FIG. 5 shows an alternate form of the present invention. According to this alternate form, the belt keeper 4 has two inward plug pins 412 respectively raised from its lugs 41, and respectively fitted into the pivot holes 217 on the lugs 211 of the mounting frame 21.

Figure 6:
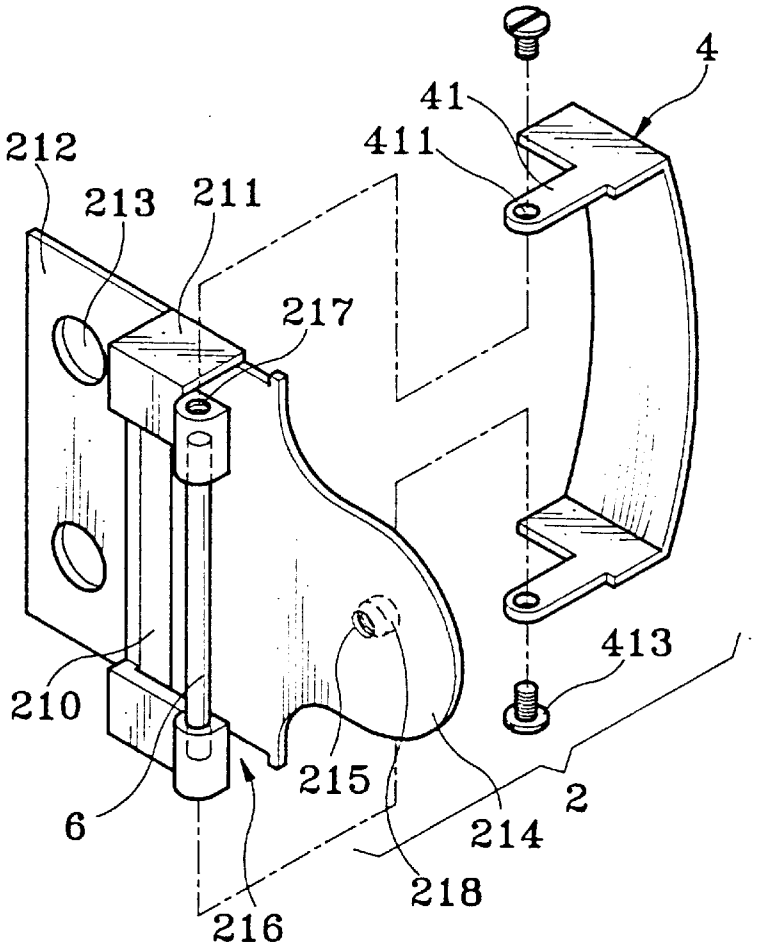
FIG. 6 is an exploded view of a part of another alternate form of the present invention.

FIG. 6 shows another alternate form of the present invention. According to this alternate form, the pivot holes 217 on the lugs 211 of the mounting frame 21 are screw holes; the pivot holes 411 on the lugs 41 of the belt keeper 4 are respectively connected to the pivot holes 217 on the lugs 211 of the mounting frame 21 by a respective screw 413.

It is to be understood that the drawings are designed for purposes of illustration only, and are not intended as a definition of the limits and scope of the invention disclosed.

What I claim is:

1. A belt and buckle arrangement comprising:

a buckle unit, said buckle unit comprising a frame and tongue unit, and a mounting strip fastened to said frame and tongue unit at one end, said mounting strip comprising a first part having one end terminating in a coupling portion, and a second part integral with one end of said first part remote from said coupling portion, said second part being inserted through said frame and tongue unit and then covered over a part of said first part and fixed thereto to secure said frame and tongue unit to said mounting strip;

a belt having a lead end connected to said coupling portion of said mounting strip;

a connecting device adapted to connect said belt to said mounting strip, said connecting device comprised of a mounting frame fastened to the coupling portion of said mounting strip, the mounting frame including a transverse stop plate extending from a bottom side thereof for stopping the lead end of the belt, and a locking lever pivoted to said mounting frame and adapted to hold down said belt on said mounting frame, said locking lever having an engaging portion adapted to engage the lead end of said belt; and a fastening means adapted to fix said mounting frame of said connecting device to said coupling portion of said mounting strip of said buckle unit.

2. The belt and buckle arrangement of claim 1, further including a belt keeper fastened to said mounting frame of said connecting device for maintaining a tail end of said belt in place, wherein said belt keeper comprises two lugs perpendicularly raised from two opposite ends thereof and respectively connected to said mounting frame of said connecting device at two opposite sides.

3. The belt and buckle arrangement of claim 2, wherein said mounting frame of said connecting device comprises two lugs at two opposite sides, and a pivot connected between the lugs on said mounting frame of said connecting device and adapted to hold said locking lever; the lugs of said belt keeper have a respective hole respectively connected to two opposite ends of said pivot.

4. The belt and buckle arrangement of claim 3, wherein said mounting frame of said connecting device comprises two retaining notches at two opposite sides adapted to receive the lugs of said belt keeper.

5. The belt and buckle arrangement of claim 2, wherein said mounting frame of said connecting device comprises two lugs at two opposite sides, the lugs of said mounting frame comprising a respective pivot hole, and a pivot connected in the pivot holes between the lugs on said mounting frame and adapted to hold said locking lever; the lugs of said belt keeper have a respective inward plug at an inner side respectively fitted into the pivot holes on the lugs of said mounting frame of said connecting device.

6. The belt and buckle arrangement of claim 5, wherein said mounting frame of said connecting device comprises two retaining notches at two opposite sides adapted to receive the lugs of said belt keeper.

7. The belt and buckle arrangement of claim 2, wherein said mounting frame of said connecting device comprises two lugs at two opposite sides, the lugs of said mounting frame comprising a respective pivot hole, and a pivot connected between the lugs on said mounting frame of said connecting device and adapted to hold said locking lever; the lugs of said belt keeper have a respective hole respectively connected to the pivot holes on the lugs of said mounting frame of said connecting device by a respective screw.

8. The belt and buckle arrangement of claim 7, wherein said mounting frame of said connecting device comprises two retaining notches at two opposite sides adapted to receive the lugs of said belt keeper.

* * * * *